US012669053B1

(12) United States Patent
Afifi et al.

(10) Patent No.: US 12,669,053 B1
(45) Date of Patent: Jun. 30, 2026

(54) HYDROGEN SHOW ASSESSMENT VIA ADVANCED MUD GAS DATA

(71) Applicant: SAUDI ARABIAN OIL COMPANY, Dhahran (SA)

(72) Inventors: Ruba M. Afifi, Dhahran (SA); Nikolaos A. Michael, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/266,445

(22) Filed: Jul. 11, 2025

(51) Int. Cl.
*E21B 49/08* (2006.01)
*E21B 47/00* (2012.01)

(52) U.S. Cl.
CPC ..... *E21B 49/08* (2013.01); *E21B 47/00* (2013.01)

(58) Field of Classification Search
CPC ..... E21B 49/08; E21B 47/00
See application file for complete search history.

(56) References Cited

U.S. PATENT DOCUMENTS

| | | | | |
|---|---|---|---|---|
| 9,528,364 | B2 * | 12/2016 | Samuel | E21B 47/006 |
| 11,047,232 | B2 * | 6/2021 | Knight | G16B 10/00 |
| 11,796,527 | B2 | 10/2023 | Rowe | |
| 12,065,929 | B2 * | 8/2024 | Moreno Sierra | G01N 23/223 |
| 12,203,918 | B2 | 1/2025 | Yang et al. | |
| 12,210,129 | B2 | 1/2025 | Yang | |
| 2015/0219782 | A1 | 8/2015 | Viswanathan et al. | |
| 2015/0284811 | A1 * | 10/2015 | Knight | G16B 20/00 506/8 |
| 2015/0300151 | A1 * | 10/2015 | Mohaghegh | E21B 47/07 702/9 |
| 2018/0347354 | A1 * | 12/2018 | Li | G06N 20/00 |
| 2019/0368345 | A1 | 12/2019 | Rowe et al. | |

(Continued)

FOREIGN PATENT DOCUMENTS

| | | | |
|---|---|---|---|
| CN | 105401933 | A | 3/2016 |
| WO | 2023234782 | A1 | 12/2023 |

OTHER PUBLICATIONS

Strapoc, Dariusz, et al., Key Role of Regearing Mud Gas Logging For Natural H2 Exploration, Paper presented at the SPWLA 63rd Annual Logging Symposium, Stavanger, Norway, Jun. 2022.

(Continued)

*Primary Examiner* — Shane Bomar
(74) *Attorney, Agent, or Firm* — Vorys, Sater, Seymour and Pease LLP

(57) ABSTRACT

A computer-implemented method for quantifying and assessing hydrogen shows in geological formations includes receiving raw advanced mud gas data including hydrogen gas and total hydrocarbon concentrations for one or more geological formations in a geographical area, calculating a baseline concentration value of hydrogen gas for each geological formation and removing said baseline concentration value from the raw advanced mud gas data, constructing corrected hydrogen gas concentration curves via cleaning of the raw advanced mud gas data, transforming the corrected hydrogen gas concentration curves into corresponding hydrogen gas concentration indices to categorize hydrogen shows by strength, and grouping the hydrogen gas concentration indices by geographical location to identify potential sources of hydrogen gas for extraction operations.

20 Claims, 7 Drawing Sheets

(56) References Cited

U.S. PATENT DOCUMENTS

2024/0320405 A1* 9/2024 Atwah ..... G06F 30/28

OTHER PUBLICATIONS

Zgonnik, V., The occurrence and geoscience of natural hydrogen: A comprehensive review, 2020, Earth-Science Reviews, 203.
Prinzhofer, Alain, et al., Natural hydrogen and blend gas: a dynamic model of accumulation. International Journal of Hydrogen Energy, vol. 46, Issue 57, 2023, pp. 21610-21623.

* cited by examiner

302

| H2 ppm | H2 index | H2 Show Category |
|---|---|---|
| 0 | 0 | |
| 300 | 0.1 | Weak |
| 600 | 0.2 | |
| 1000 | 0.3 | |
| 3000 | 0.4 | |
| 5000 | 0.5 | Moderate |
| 7000 | 0.6 | |
| 10000 | 0.7 | Strong |
| 15000 | 0.8 | |
| 20000 | 0.9 | Very Strong |
| 100000 | 1 | |

304 306 308

FIG. 3A

310

| H2/C1 | H2/HC | Adjustment coefficient |
|---|---|---|
| <= 0.5 | <= 0.5 | -0.1 |
| 0.5 - 1.0 | 0.5 - 1.0 | 0 |
| >= 1.0 | >= 1.0 | 0.1 |

FIG. 3B 312 306 308 314 316

| Well | Depth | Formation | H2 index (1st pass) | H2 Show Category | H2/C1 | H2/HC | H2 index (2nd pass) | Adjusted H2 Show Category |
|---|---|---|---|---|---|---|---|---|
| Well 1 | 10728 | A | 0.4 | Moderate | 0.413 | 0.364 | 0.2 | Weak |
| Well 1 | 10729 | A | 0.4 | Moderate | 0.414 | 0.362 | 0.2 | Weak |
| Well 1 | 10730 | A | 0.4 | Moderate | 0.402 | 0.356 | 0.2 | Weak |
| Well 1 | 10731 | A | 0.4 | Moderate | 0.402 | 0.354 | 0.2 | Weak |
| Well 1 | 10732 | A | 0.6 | Moderate | 1.053 | 0.928 | 0.7 | Strong |
| Well 1 | 10733 | A | 0.6 | Moderate | 1.080 | 0.920 | 0.7 | Strong |
| Well 1 | 10734 | A | 0.6 | Moderate | 1.012 | 0.853 | 0.7 | Strong |
| Well 1 | 10735 | A | 0.6 | Moderate | 1.012 | 0.861 | 0.7 | Strong |
| Well 1 | 10736 | A | 0.6 | Moderate | 1.008 | 0.847 | 0.7 | Strong |
| Well 1 | 10737 | A | 0.6 | Moderate | 1.048 | 0.883 | 0.7 | Strong |
| Well 1 | 10738 | B | 0.6 | Moderate | 0.984 | 0.875 | 0.6 | Moderate |
| Well 1 | 10739 | B | 0.6 | Moderate | 0.992 | 0.838 | 0.6 | Moderate |
| Well 1 | 10740 | B | 0.6 | Moderate | 0.973 | 0.816 | 0.6 | Moderate |
| Well 1 | 10741 | B | 0.6 | Moderate | 0.917 | 0.752 | 0.6 | Moderate |
| Well 1 | 10742 | B | 0.6 | Moderate | 0.944 | 0.787 | 0.6 | Moderate |
| Well 1 | 10743 | B | 0.6 | Moderate | 0.960 | 0.799 | 0.6 | Moderate |
| Well 1 | 10744 | B | 0.6 | Moderate | 0.992 | 0.828 | 0.6 | Moderate |

FIG. 3C

HYDROGEN SHOW ASSESSMENT VIA ADVANCED MUD GAS DATA

FIELD OF THE DISCLOSURE

The present disclosure relates generally to the exploration and identification of subterranean sources of hydrogen gas for extraction and utilization.

BACKGROUND OF THE DISCLOSURE

As energy providers convert existing hydrocarbon plants to low-carbon fuel systems, such as hydrogen fuel stations, the establishment of natural hydrogen exploration protocols will become increasingly important. To enable the extraction of naturally-occurring hydrogen gas from underground reservoirs, geographical areas and corresponding subterranean formations can be explored and assessed for possible hydrogen gas content. Current methods of hydrogen exploration can include seismic surveys, geochemical analyses, sensor deployments, and other costly techniques. The time and capital required by these current methods of hydrogen exploration, however, can be prohibitive for locating and extracting hydrogen gas in an efficient and profitable manner.

In contrast, methods for the exploration and assessment of hydrocarbon reservoirs have been extensively developed in order to locate and extract hydrocarbon products while remaining cost-effective and timely. Many of the methods used in hydrocarbon exploration, however, fail to be as efficient and effective in determining hydrogen gas reservoirs and geological structures related thereto. Varying levels of concentrations, sensor accuracy, dispersal and migration, and sampling challenges related to hydrogen gas can negatively impact the effectiveness of well-known hydrocarbon exploration methods. While hydrocarbon exploration and assessment methods have been developed to utilize advanced mud gas data to characterize the extraction potential of various subterranean formations and wellbores, similar methods of leveraging advanced mud gas data to characterize hydrogen shows have been lacking in the industry.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

In an embodiment consistent with the present disclosure, a computer-implemented method for quantifying and assessing hydrogen shows in geological formations includes receiving raw advanced mud gas data including hydrogen gas and total hydrocarbon concentrations for one or more geological formations in a geographical area, calculating a baseline concentration value of hydrogen gas for each geological formation and removing said baseline concentration value from the raw advanced mud gas data, constructing corrected hydrogen gas concentration curves via cleaning of the raw advanced mud gas data, transforming the corrected hydrogen gas concentration curves into corresponding hydrogen gas concentration indices to categorize hydrogen shows by strength, and grouping the hydrogen gas concentration indices by geographical location to identify potential sources of hydrogen gas for extraction operations.

In another embodiment, a system for quantifying and assessing hydrogen shows in geological formations includes a data cleaning engine operable to receive advanced mud gas data and construct corrected hydrogen gas concentration curves, the data cleaning engine including a baseline concentration module operable to calculate a baseline concentration value of hydrogen gas for each geological formation and remove said baseline concentration value from the advanced mud gas data. The system further includes a mud gas data interpretation engine operable to receive the corrected hydrogen gas concentration curves and perform further transformations to categorize hydrogen shows by strength, the mud gas data interpretation engine including an index value module operable to transform the corrected hydrogen gas concentration curves into corresponding hydrogen gas concentration indices, and a mud gas weighting module operable to determine a ratio between hydrogen gas and other mud gases from the advanced mud gas data and offset the hydrogen gas concentration indices based upon said ratio, said hydrogen gas concentration indices representing a standardized, relative strength of each hydrogen show in the geological formations for potential hydrogen gas extraction operations.

In a further embodiment, a non-transitory computer-readable medium storing machine-readable instructions, which, when executed by a processor of an electronic device, cause the electronic device to receive raw advanced mud gas data including hydrogen gas and total hydrocarbon concentrations for one or more formations in a geographical area, calculate a baseline concentration value of hydrogen gas for each formation and remove said baseline concentration value from the raw advanced mud gas data, and construct a discount function to correct for an overestimation of hydrogen gas concentration in the raw advanced mud gas data based upon additives, corrosion, drilling mud content, or any combination thereof to construct corrected hydrogen gas concentration curves. The instructions further cause the electronic device to transform the corrected hydrogen gas concentration curves into corresponding hydrogen gas concentration indices to categorize hydrogen shows by strength, determine a ratio between hydrogen gas and other mud gases from the advanced mud gas data and offset the hydrogen gas concentration indices based upon said ratio, construct a geographical representation of the hydrogen gas concentration indices across the formations to identify potential hydrogen gas reservoirs for the potential hydrogen gas extraction operations, and construct and identify potential hydrogen gas migration pathways within the geographical representation, the potential hydrogen gas migration pathways enabling assessments of hydrogen gas presence and charge history for the formations.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

BRIEF DESCRIPTION OF THE DRAWINGS

FIG. 3A illustrates a sample index correlation chart for ranking the strength of a hydrogen show, according to an embodiment of the present disclosure.

FIG. 3B illustrates sample hydrogen gas concentration offset guidelines based upon a ratio of hydrogen gas to other mud gases, according to an embodiment of the present disclosure.

FIG. 3C illustrates sample hydrogen show data for multiple formations in a single well, according to an embodiment of the present disclosure.

DETAILED DESCRIPTION

Figure 1:
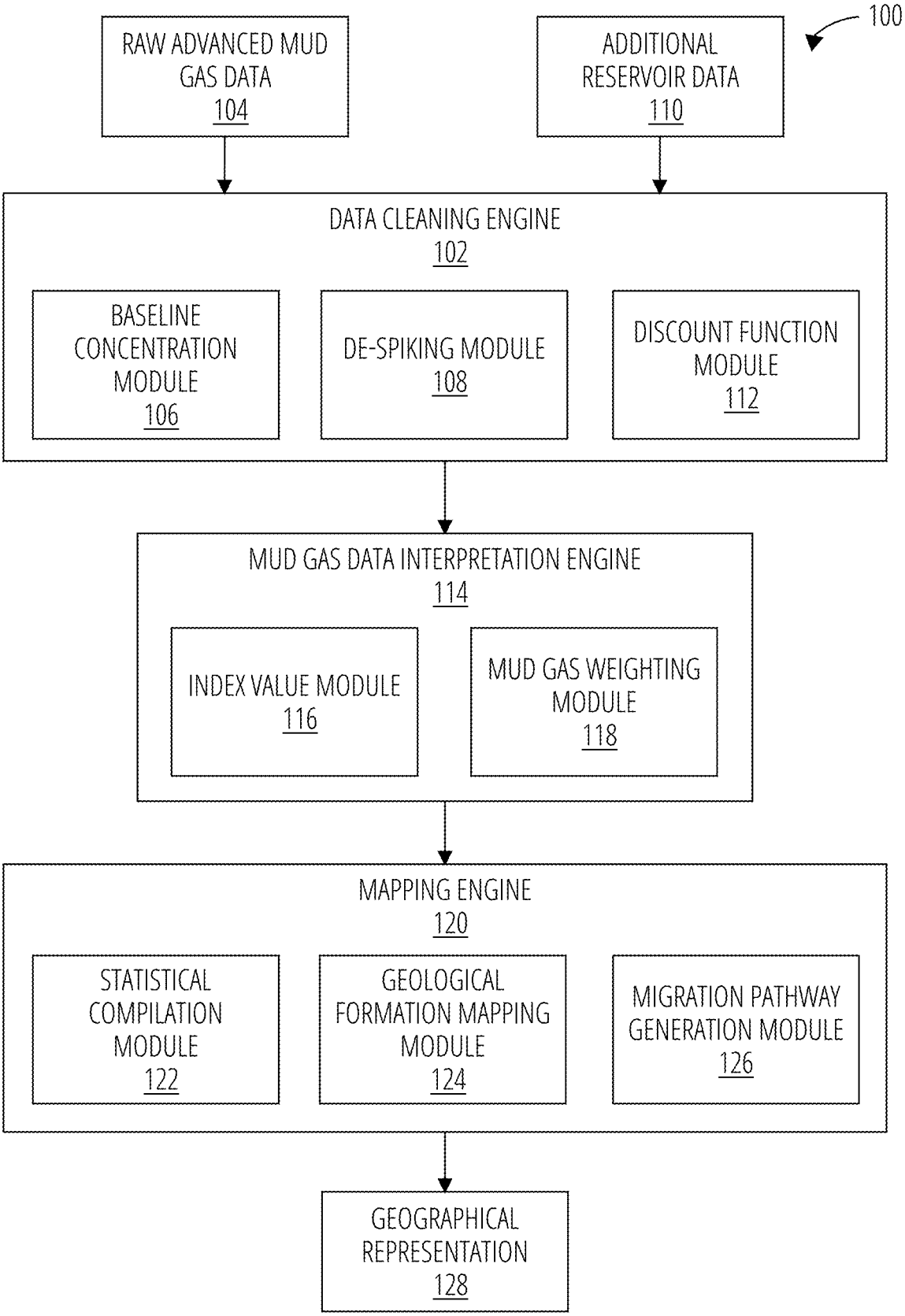
FIG. 1 is a schematic view of an example system for identifying and characterizing the strength of hydrogen shows in a geographical area, according to an embodiment of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to identifying subterranean sources of hydrogen gas for extraction and utilization, and, more particularly, to leveraging advanced mud gas data to identify hydrogen shows and map hydrogen migration pathways in a reservoir. Embodiments disclosed herein include systems and methods for identifying and characterizing the strength of hydrogen shows in a geographical area. The disclosed methods and systems included herein can utilize available advanced mud gas (AMG) data, and can clean and weight the hydrogen gas concentrations found in the raw AMG data. The embodiments of the present disclosure can account for the presence of additional gases that can skew the accurate measurement of hydrogen gas, such that the strength of the possible hydrogen gas concentration can be accordingly adjusted.

Using the cleaned and adjusted hydrogen gas concentrations, the disclosed methods and systems can enable the classification of a strength of each hydrogen show, such that a hydrogen show index can be assigned to each measurement at each depth for use in the assessment of hydrogen gas reservoirs and migration pathways. The methods and systems disclosed herein can further include the mapping of the hydrogen concentration indices and migration pathways on a geographical representation of a multi-reservoir region. The geographical representation can enable an operator to determine ideal sources of subterranean hydrogen gas. In further embodiments, the systems and methods disclosed herein can adjust or initiate extraction operations within the multi-reservoir location based upon the geographical representation and the hydrogen gas concentration indices. The disclosed methods and systems can accordingly enable the efficient and cost-effective exploration and extraction of naturally-occurring hydrogen gas through the use of available AMG and other well data.

FIG. 1 is a schematic view of an example system 100 for identifying and characterizing the strengths of hydrogen shows in a geographical area, according to an embodiment of the present disclosure. System 100 includes a data cleaning engine 102 operable to receive raw AMG data 104 and construct corrected hydrogen gas concentration curves therefrom. To accomplish construction of the corrected hydrogen gas concentration curves, data cleaning engine 102 can include a baseline concentration module 106 operable to assess a baseline concentration of hydrogen gas for each formation or each reading, and accordingly subtract the baseline concentration from the raw AMG data 104. Data cleaning engine 102 can further include a de-spiking module 108 operable to identify and assess any values of the hydrogen concentration exceeding neighboring measurements by several standard deviations, and further replace these values with average values of the neighboring measurements. In some embodiments, data cleaning engine 102 can further receive additional reservoir data 110 that can include mud data, length of penetration, and other wellbore data. Data cleaning engine 102 can use this additional reservoir data 110 in a discount function module 112 operable to assess and account for any contamination in raw AMG data 104, such that any contaminating processes (e.g., drill-bit metamorphism) can be considered during the data cleaning of the hydrogen concentration measurements.

System 100 can further include a mud gas data interpretation engine 114 in communication with data cleaning engine 102 and operable to convert corrected hydrogen gas concentration curves into hydrogen concentration indices via an index value module 116. Mud gas data interpretation engine 114 can further include a mud gas weighting module 118 operable to account for the presence of other mud gases, such as hydrocarbons, and adjust the assigned hydrogen concentration indices in response. System 100 can further include a mapping engine 120 in communication with mud gas data interpretation engine 114 and operable to compile, via a statistical compilation module 122, and map, via a geological formation mapping module 124 and migration pathway generation module 126, the hydrogen gas concentration indices and migration pathways of the hydrogen gas in order to construct a geographical representation 128 of the area of interest with pertinent hydrogen gas information. Mapping engine 120 and geographical representation 128 can be useful in the assessment of the region of interest for hydrogen gas extraction operations, such that geographical representation 128 can directly inform operators of available resource sinks and migration pathways for naturally-occurring, subterranean hydrogen gas.

Raw AMG data 104 can be obtained via a plurality of sensors and tools arranged at or near the geological formations of interest. In particular, raw AMG data 104 can be obtained via mud logging techniques employed in an active wellbore, such that raw AMG data 104 is sourced from analysis performed directly on the circulated mud within the wellbore. Additional reservoir data 110 can similarly be obtained from an active wellbore, or a nearby geological formation of interest. In some embodiments, additional reservoir data 110 can include well top data that defines stratigraphic depths, drilling parameters, mud compositions, and other sensor readings and operational parameters for the formation of interest. Both raw AMG data 104 and additional reservoir data 110 can be received within data cleaning engine 102 and mud gas data interpretation engine 114 to perform the data transformations for assessing hydrogen gas concentrations through the geological formations of interest.

Data cleaning engine 102 can receive raw AMG data 104 and additional reservoir data 110 in order to generate corrected hydrogen gas concentration curves, which can be correspondingly provided to mud gas data interpretation engine 114 for the assessment of relative hydrogen show strength. As such, data cleaning engine 102 can include baseline concentration module 106, which is operable to parse hydrogen gas concentrations at a variety of depths in at least one well and formation. Baseline concentration module 106 can determine a baseline hydrogen gas concentration found throughout the formation, and can accordingly correct the hydrogen gas concentration value at each depth to remove the baseline concentration therefrom. In some embodiments, the baseline hydrogen gas concentration can be equivalent to a fifth percentile of the moving average for the hydrogen gas concentration throughout each well. The removal of the baseline concentration via baseline concentration module 106 can enable increased confidence in any hydrogen gas concentration assessments, as the background hydrogen gas levels present throughout the well can be accounted for and removed. As such, any hydrogen gas concentration present after correction via baseline concentration module 106 is considered elevated above the baseline value and thus statistically significant.

Data cleaning engine 102 can further utilize de-spiking module 108 to correct for any outliers in raw AMG data 104, particularly for any maximum concentration values that can be a result of sampling issues. De-spiking module 108 can assess raw AMG data 104, and can particularly determine the magnitude differences between neighboring depth measurements for the well or formation of interest. Using these magnitude differences, de-spiking module 108 can determine if any of these differences exceed multiple (e.g., 2 or 3) standard deviations for the entire dataset. For these excessive magnitude differences, the hydrogen gas concentration value can be corrected to replace any erroneous data points or measurements. To this end, de-spiking module 108 can determine an averaged value for neighboring depth measurements and can replace the outlying measurement with the averaged value. Between baseline concentration module 106 and de-spiking module 108, the maximum and minimum values of hydrogen gas concentration can be normalized and corrected, such that the updated dataset can be utilized with increased confidence by mud gas data interpretation engine 114.

In some embodiments, data cleaning engine 102 can employ discount function module 112 to correct for possible contamination within raw AMG data 104 and/or the updated dataset resulting therefrom. Discount function module 112 can leverage both raw AMG data 104 and additional reservoir data 110 to determine contamination of the hydrogen gas concentration readings, which can include the introduction of additives, consequences of corrosion, metamorphism of drill bits within the wellbore, and other contamination methods that can impact raw AMG data 104. In some embodiments, discount function module 112 can construct a discount function to be applied to the hydrogen gas concentration values following correction by baseline concentration module 106 and de-spiking module 108. In these embodiments, the discount function can range from zero to one, and the corrected hydrogen gas concentration values can be multiplied by the discount function to scale down the values if contamination is identified.

Following the various cleaning performed via data cleaning engine 102, corrected hydrogen gas concentration curves can be provided to mud gas data interpretation engine 114 from data cleaning engine 102. Mud gas data interpretation engine 114 can receive the corrected hydrogen gas concentration curves and utilize index value module 116 to classify each depth value based upon the relative strength of the hydrogen show. For classifying the relative strength of each hydrogen gas reading at each depth, a plurality of range bands can be established using the parts-per-million (ppm) concentration measurements (see FIG. 3A). Index value module 116 can quantify this relative strength using an index value ranging from zero to one, with zero indicating no significant hydrogen concentration past the baseline value and one indicating a rich hydrogen show. The conversion of corrected hydrogen gas concentration curves into the hydrogen gas indices, via index value module 116, can enable enhanced visualization and translatability of the concentration data.

Mud gas data interpretation engine 114 can perform additional adjustment of the index values obtained from index value module 116, such that further corrections can be applied to increase confidence in the indices. As such, mud gas data interpretation engine 114 can utilize mud gas weighting module 118 to assess the ratios between hydrogen gas and other mud gases, and apply corrections to the hydrogen show indices as a result. Mud gas weighting module 118 can utilize raw AMG data 104 and/or additional reservoir data 110 to determine concentrations of various other mud gases, such as carbon dioxide, helium, methane, total hydrocarbons, and any combination thereof. Using pre-determined ratio ranges (see FIG. 3B), mud gas weighting module 118 can determine a constant to be added to, or subtracted from, the index values. In some embodiments, high ratios (e.g., greater than one) can indicate that hydrogen gas is in greater quantities than relevant other gases, such that the confidence of the hydrogen show can be increased. Conversely, lower ratios (e.g., less than 0.5) can indicate that hydrogen gas is less prevalent than other gases, and that the hydrogen gas concentration measurements can account for these hydrocarbons in error. As such, in these embodiments, the values of the hydrogen show indices can be decreased by a static value to indicate the decreased confidence in hydrogen gas being present in abundance.

Following the interpretation and further adjustment of the hydrogen show indices via mud gas data interpretation engine 114, the corrected hydrogen show indices can be provided to mapping engine 120 for conversion to useful planning tools. In some embodiments, mapping engine 120 can utilize statistical compilation module 122 to group the hydrogen show indices by well within each formation of interest. Statistical compilation module 122 can construct summarized attributes that reflect the compiled values of the hydrogen show indices, such as a mean and median value and/or a maximum and minimum hydrogen show index value, to enable characterization of each well and each formation. The statistical compilation can provide unified and usable values for the wells and formations of the geographical area, such that hydrogen gas planning and extraction operations can be performed. In some embodiments, statistical compilation module 122 can prioritize maximum values to identify promising formations and regions of interest. In further embodiments, however, statistical compilation module 122 can prioritize and present average values for use in volumetric calculations to assess possible volumes of available hydrogen gas.

In some embodiments, mapping engine 120 can further utilize geological formation mapping module 124 to overlay these unified values for the wells and formations on a geographical representation 128 of the region of interest. Geographical representation 128 can provide a map view of the region of interest, with each of the formations and wells represented therein, and with the corrected hydrogen show indices overlaid thereon. Geological formation mapping module 124 can construct geographical representation 128 to provide simple, user-friendly views of the hydrogen concentration values throughout the region of interest, through the use of the overlaid hydrogen show indices that indicate likely strengths of hydrogen shows with a range from zero to one. In some embodiments, mapping engine 120 can additionally utilize migration pathway generation module 126 to identify and construct gradients and migration pathways for hydrogen gas in the region of interest. Migration pathway generation module 126 can utilize the gradients and geographical representation 128 to determine the pathways through which the hydrogen gas may have migrated and charged the various formations, through fractures, faults, porous media, man-made wellbores, and other geological features under the regions of interest. As such, migration pathway module 126 can determine historical sources of hydrogen gas, the mechanism of creation and accumulation for the hydrogen gas, and aid in understanding the current hydrogen gas distribution in the region of interest. Determining both the strength of hydrogen shows and the migration pathways in mapping engine 120 can enable assessment of the charge history for the region of interest while enabling risk assessments to be made for exploration and extraction operations therein.

Figure 2:
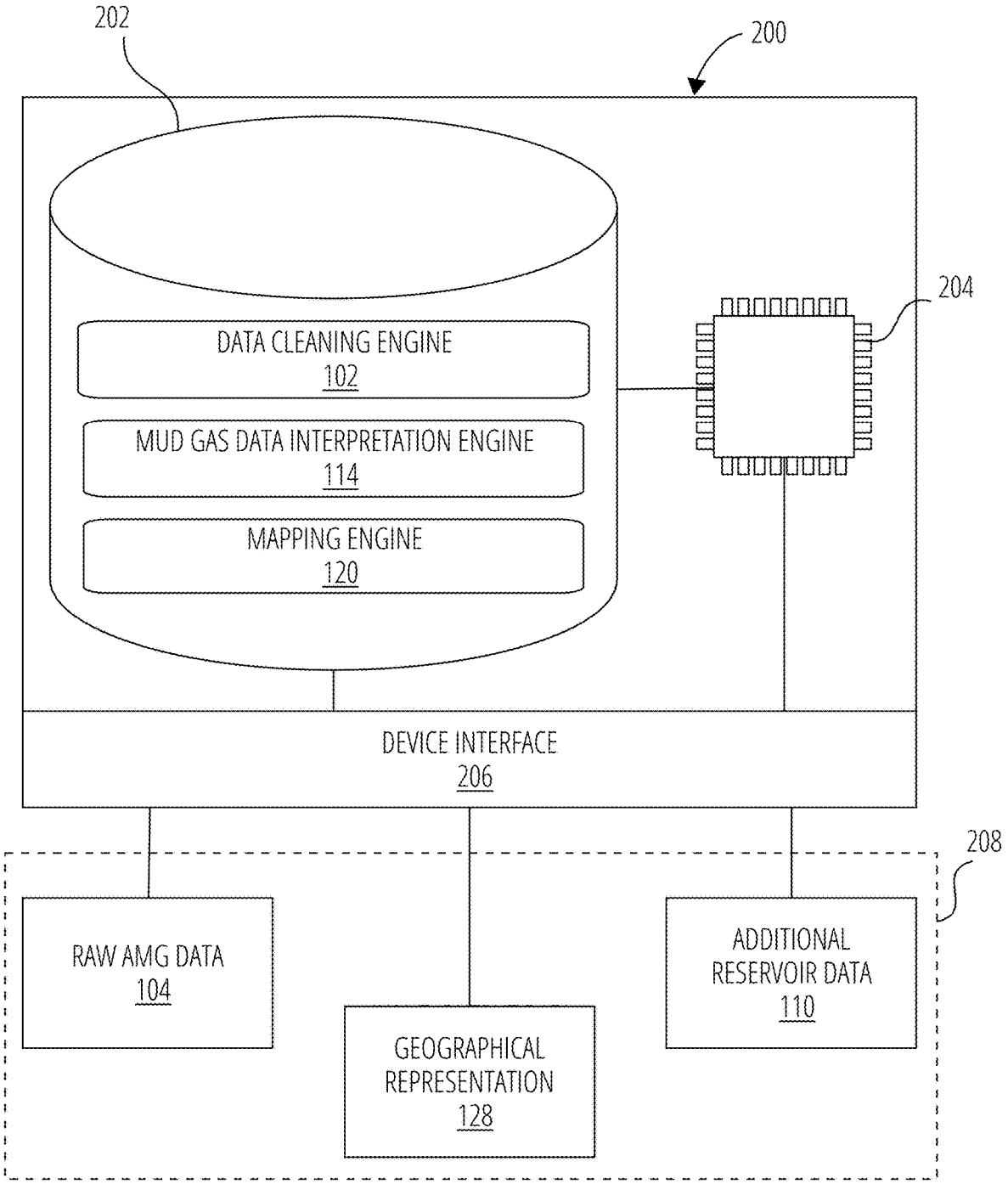
FIG. 2 is a schematic view of an example electronic device operable to identify and characterize the strength of hydrogen shows in a geographical area, according to an embodiment of the present disclosure.

FIG. 2 is a schematic view of an example electronic device 200 operable to identify and characterize the strength of hydrogen shows in a geographical area, according to an embodiment of the present disclosure. Electronic device 200 can primarily include a non-transitory computer-readable medium 202 communicatively coupled to a processor 204 for the execution of instructions stored within the non-transitory computer-readable medium 202. Electronic device 200 can further include device interface 206 operable to communicate with various communicatively-coupled tools located at or near the wellbore or region of interest, such that various measurements and data can be extracted therefrom. In some embodiments, the tools communicatively-coupled can include the logging tools and sensors used in obtaining raw AMG data 104 and additional reservoir data 110 of FIG. 1, as well as any exploration and extraction tools that can be informed and instructed by electronic device 200 to perform hydrogen gas extraction operations.

As discussed above, non-transitory computer-readable medium 202 can be communicatively-coupled to processor 204 as part of electronic device 200, such that any instructions stored within non-transitory computer-readable medium 202 can be executed via processor 204. In some embodiments, the instructions stored in non-transitory computer-readable medium 202 can include data cleaning engine 102, mud gas data interpretation engine 114, mapping engine 120, and any combination thereof. As such, electronic device 200 can be operable to communicate with external tooling to obtain raw AMG data 104 and additional reservoir data 110 of FIG. 1, clean and correct the received data, interpret the mud gas data into a user-friendly format, map the strength of the hydrogen shows for each wellbore and formation in the region of interest, and communicate with further tooling operable to perform hydrogen gas extraction operations. In some embodiments, electronic device 200 can utilize the migration pathways to determine prospects for drilling operations, as well as likely candidates for further extraction if hydrogen gas has traveled via migration pathways to a new formation.

FIG. 3A illustrates a sample index correlation chart 302 for ranking the strength of a hydrogen show, according to an embodiment of the present disclosure. In some embodiments, mud gas data interpretation engine 114 and index value module 116 can utilize sample index correlation chart 302 for assessing and classifying the strength of the corrected hydrogen gas concentration curves. Sample index correlation chart 302 includes hydrogen concentration 304 values in ppm that correspond to the received values of the corrected hydrogen gas concentration curves, along with corresponding index values 306 and hydrogen show strength categories 308. Index values 306 can range from zero to one, as discussed above, such that a value of zero indicates only baseline hydrogen concentrations and a value of one indicates an ideal, hydrogen-rich show. Within the range of zero to one of index values 306, multiple hydrogen show strength categories 308 can be included that refer to the relative strength of the hydrogen show. In the illustrated embodiment, a value of about 0.1 to about 0.3 can indicate a weak show, a value of about 0.4 to about 0.6 can indicate a moderate show, a value of about 0.7 to about 0.8 can indicate a strong show, while a value of about 0.9 to about 1 indicates a very strong hydrogen show. It is worth noting that index values 306 can be exponentially-related to hydrogen concentrations 304, such that an index value 306 of 0.7 correlates to a hydrogen concentration 304 of 10,000 ppm, while an index value 306 of 1 correlates to a hydrogen concentration 304 of 100,000 ppm. In further embodiments, however, the relationship between hydrogen concentration 304 and index value 306 can be linearly or otherwise related without departing from the scope of the present disclosure.

FIG. 3B illustrates sample hydrogen gas concentration offset guidelines 310 based upon a ratio of hydrogen gas to other mud gases, according to an embodiment of the present disclosure. As discussed above, the ratio between hydrogen gas and other mud gases can be utilized via mud gas weighting module 118 of FIG. 1 to adjust index values 306. Sample hydrogen gas concentration offset guidelines 310 provides ratio range bands for hydrogen gas versus single-carbon hydrocarbons and total hydrocarbons. In some embodiments, a value of 0.1 can be added to each hydrogen gas concentration index value if both of the ratios between hydrogen gas and single carbon hydrocarbons and total hydrocarbons are greater than one. Conversely, in further embodiments, a value of 0.1 can be subtracted from each hydrogen gas concentration index value if both of the aforementioned ratios are less than or equal to 0.5. The use of the gas ratios and sample hydrogen gas concentration offset guidelines 310 can enable increased confidence in the accuracy of the hydrogen show indices, such that measurement errors due to other gases and other hydrogen-rich molecules are accounted for in the index values 306.

FIG. 3C illustrates sample hydrogen show data 312 for multiple formations in a single well, according to an embodiment of the present disclosure. Sample hydrogen show data 312 can include an identification of the well of interest, the depth at which the measurement is taken, an identification of the formation of interest, as well as the application of sample hydrogen gas concentration offset guidelines 310 based upon initial index values 306 and mud gas concentrations. In sample hydrogen show data 312, an initial assessment of hydrogen show strength category 308 can be seen, such that each measurement is initially considered of moderate strength. However, through the use of sample hydrogen gas concentration offset guidelines 310, a second pass 314 of index values 306 can be seen following adjustment for mud gas ratios (e.g., via mud gas weighting module 118). Accordingly, adjusted hydrogen show strength categories 316 are further provided in sample hydrogen show data 312, such that a spread is shown between weak and strong hydrogen shows following adjustment based on the gas ratios. Sample hydrogen show data 312 illustrates the value of sample hydrogen gas concentration offset guidelines 310 ad mud gas weighting module 118 of FIG. 1, such that the presence or absence of other mud gases can drastically change the assumed strength of each hydrogen show.

Figure 4A:
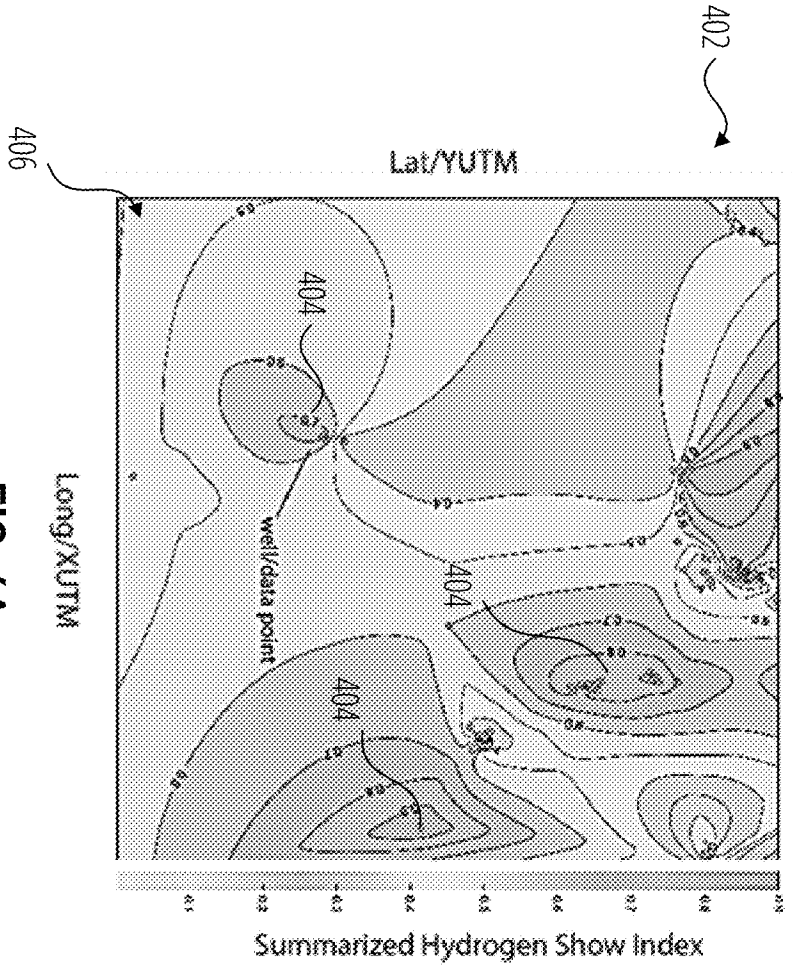
FIG. 4A illustrates a sample of mapped hydrogen show indices in a geographical area, according to an embodiment of the present disclosure.

FIG. 4A illustrates a sample of a geographical representation with mapped hydrogen show indices 402 in a geographical area, according to an embodiment of the present disclosure. Geographical representation with mapped hydrogen show indices 402 includes a plurality of well data points 404 about the region of interest 406, such that the ideal locations for hydrogen extraction operations, and the gradients of hydrogen gas concentrations are shown between each of well data points 404. Geographical representation with mapped hydrogen show indices 402 can be utilized in the identification of hydrogen gas sources, as well as the planning and deployment of extraction operations and equipment, such that hydrogen gas exploration operations can be performed with increased confidence and decreased risk.

Figure 4B:
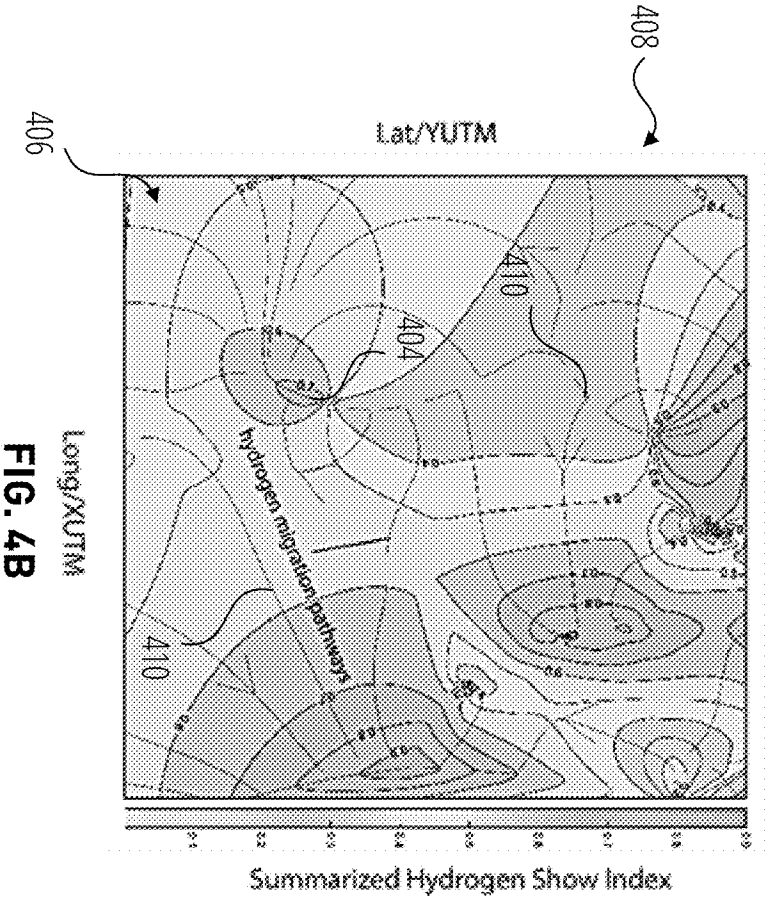
FIG. 4B illustrates a sample of mapped hydrogen gas migration pathways in the geographical area, according to an embodiment of the present disclosure.

FIG. 4B illustrates a sample of a geographical representation with mapped hydrogen gas migration pathways 408 in region of interest 406, according to an embodiment of the present disclosure. On top of well data points 404, geographical representation with mapped hydrogen gas migration pathways 408 includes a plurality of possible hydrogen gas migration pathways 410 connecting each well data point 404. Possible hydrogen gas migration pathways 410 can enable the determination of the charge history for region of interest 406, such that the mechanisms of hydrogen gas aggregation, as well as the likely sources and sinks of hydrogen gas, can be identified for further increased confidence in hydrogen gas exploration and extraction activities.

Figure 5:
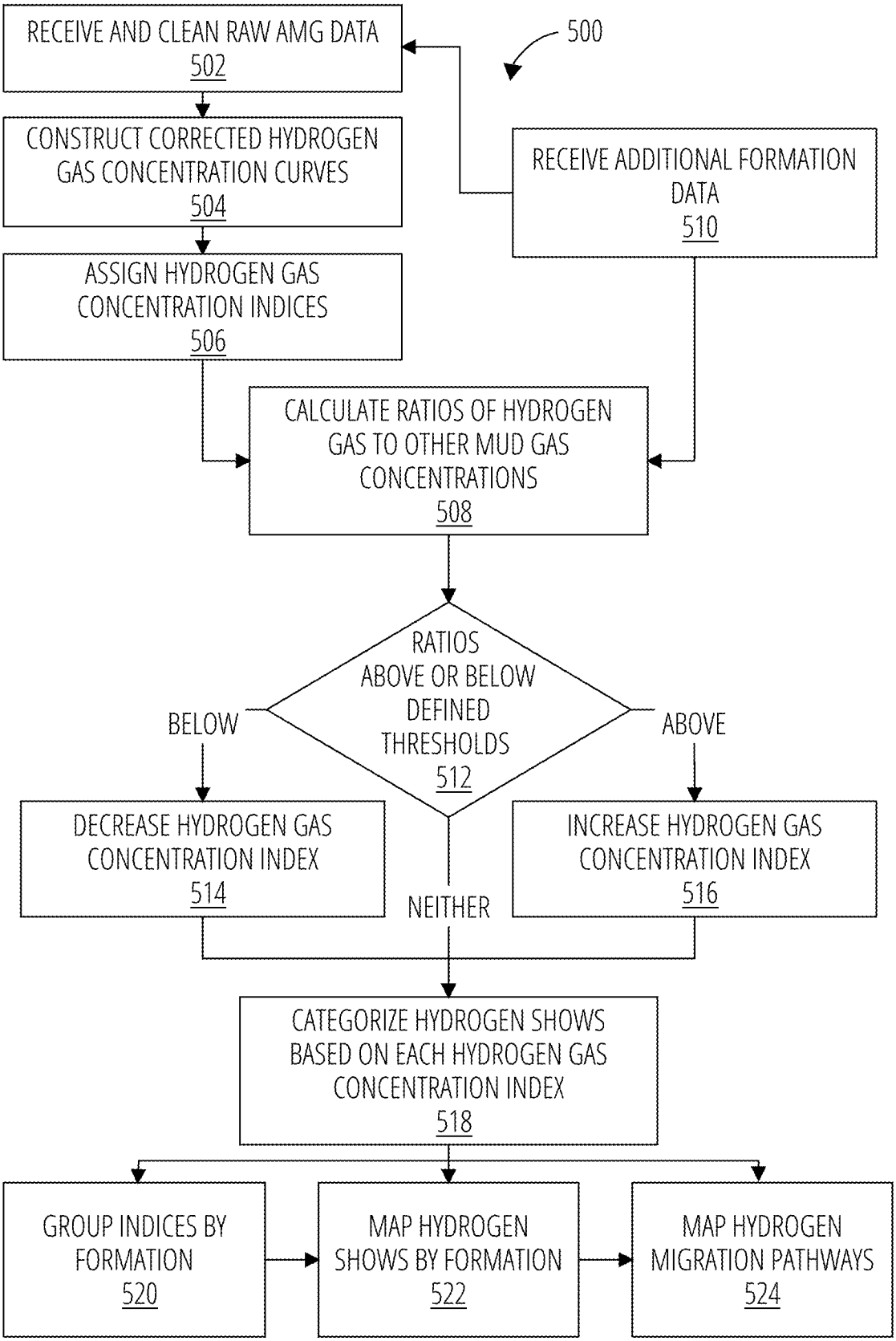
FIG. 5 is a schematic view of an example workflow for categorizing and adjusting hydrogen concentration indices using advanced mud gas data, according to an embodiment of the present disclosure.

FIG. 5 is a schematic view of an example workflow 500 for categorizing and adjusting hydrogen concentration indices using advanced mud gas data, according to an embodiment of the present disclosure. Workflow 500 can begin at 502 with receiving and cleaning raw AMG data (e.g., raw AMG data 104) for use in assessing the strength of a hydrogen show. The cleaning of the raw AMG data at 502 can be performed by a data cleaning engine (e.g., data cleaning engine 102) operable to de-spike, normalize, and correct for contamination in the raw AMG data. Following cleaning at 502, workflow 500 can continue at 504 with constructing corrected hydrogen gas concentration curves from the cleaned AMG data (e.g., via data cleaning engine 102). The corrected hydrogen gas concentration curves can include the corrected hydrogen gas measurements with the baseline concentration removed, as well as any outlying data points corrected to include a moving average. Workflow 500 can then proceed to 506 with assigning hydrogen gas concentration index values for each corrected hydrogen gas measurement of the corrected hydrogen gas concentration curves (e.g., via mud gas data interpretation engine 114 and index value module 116). The assigned hydrogen show index values can range from zero to one to represent a relative strength of the hydrogen show at each depth measurement in each well and formation.

Using the assigned hydrogen gas concentration indices from 506, workflow 500 can continue at 508 with calculating ratios comparing hydrogen gas and other mud gas concentrations, such that the relative prevalence/absence of hydrogen gas can be utilized in adjusting the hydrogen gas concentration indices (e.g., via mud gas weighting module 118). To perform these calculations and assessments, workflow 500 can further include receiving additional formation data at 510. The additional formation data can include well top data, contamination data, logging data, and other formation-related data (e.g., additional reservoir data 110). Workflow 500 can continue at 512 with the determination of whether the ratios calculated at 508 are above, below, or within defined thresholds (e.g., sample index correlation chart 302). The determination made at 512 can enable workflow 500 to adjust the hydrogen gas concentration indices to account for the presence or absence of other mud gases.

As such, workflow 500 can continue at 514 with decreasing the hydrogen gas concentration index of interest if the ratios of hydrogen gas to other mud gases are below the defined thresholds. The reduction of the hydrogen gas concentration index can represent the possible overestimation of hydrogen gas in the measurement due to other hydrogen-rich gases in the mud, which can accordingly lower confidence in the strength of the hydrogen show. Conversely, workflow 500 can continue at 516 with increasing the hydrogen gas concentration index of interest if the ratios of hydrogen gas to other mud gases are above the defined thresholds. The increase of the hydrogen gas concentration index can represent the possible underestimation of hydrogen gas in the measurement due to overestimation of the amount of other mud gases in the area, which can accordingly increase confidence in the strength of the hydrogen show at the specified depth. In further embodiments, however, if the gas ratios are within the defined thresholds, workflow 500 can continue directly to 518 with categorizing the hydrogen shows based on the hydrogen gas concentration indices. In these embodiments, the raw AMG data received at 502 can be assumed as accurate for the specified depth, as the ratios of hydrogen gas to other mud gases are within the assumed levels.

Regardless of the increase, decrease, or maintenance of hydrogen gas concentration indices resulting from 512, workflow 500 continues at 518 in order to classify each hydrogen gas concentration index as indicating weak, moderate, strong, or very strong hydrogen shows. The categorization/classification of the hydrogen gas concentration indices at 518 can further transform the initial advanced mud gas data into a user-readable format that communicates the desired result to the operator. The indices and categorizations can be compiled at 520 to group the indices and results by formation and by well. As such, the compilation at 520 can enable each well and formation to be assessed as a whole, such that the relative strength of the hydrogen shows can be aggregated for each explorable feature. The grouped indices can be further employed at 522 to map the hydrogen shows by formation and well on a geographical representation of the region of interest (e.g., geographical representation 128). The geographical representation, and any hydrogen concentration gradients obtained therefrom, can be further utilized at 524 to identify hydrogen migration pathways that can be overlaid on th geographical representation. Thus, the workflow 500 can produce mapped hydrogen shows and migration pathways to enable the determination of charge history for the geographical areas, as well as optimal locations for extraction operations.

Figure 6:
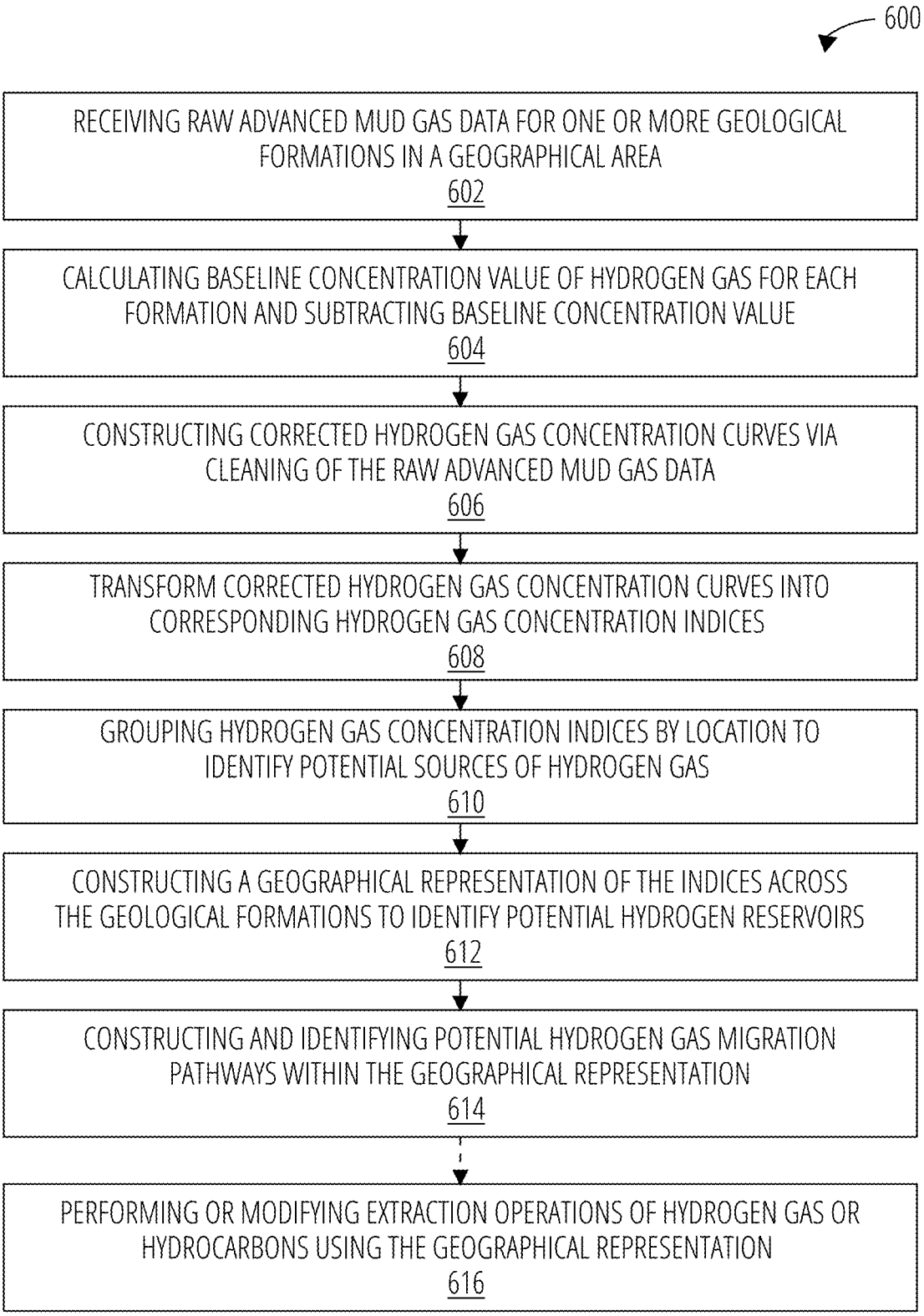
FIG. 6 illustrates a method for identifying and characterizing the strength of hydrogen shows in a geographical area. according to one or more embodiments of the present disclosure.

In view of the structural and functional features described above, example methods will be better appreciated with reference to FIG. 6. While, for purposes of simplicity of explanation, the example methods of FIG. 6 are shown and described as executing serially, it is to be understood and appreciated that the present examples are not limited by the illustrated order, as some actions could in other examples occur in different orders, multiple times and/or concurrently from that shown and described herein. Moreover, it is not necessary that all described actions be performed to implement the methods, and conversely, some actions may be performed that are omitted from the description.

FIG. 6 illustrates a method 600 for identifying and characterizing the strength of hydrogen shows in a geographical area. according to one or more embodiments of the present disclosure. Method 600 can be implemented by system 100 and/or electronic device 200, as shown in FIGS. 1-2, and using workflow 500 of FIG. 5. As such, reference may be made to the examples of FIGS. 1-5 in the description of method 600.

Method 600 can begin at 602 with receiving raw advanced mud gas data for one or more geological formations in a geographical area. The raw AMG data (e.g., raw AMG data 104) can include at least hydrogen gas and total hydrocarbon concentrations for the well and formation of interest at a plurality of depths. In some embodiments, method 600 can further include receiving additional data including mud type data, lithography data, rate of penetration data, or a combination thereof (e.g., additional reservoir data 110) at 602, such that all available mud and well data is utilized in method 600. Using the data received at 602, method 600 can continue at 604 with calculating a baseline concentration value of hydrogen gas for each geological formation and removing said baseline concentration value from the raw advanced mud gas data (e.g., via baseline concentration module 106). The calculation of baseline concentrations and subsequent removal from available data can transform the hydrogen concentration curves to be relative to the baseline concentration, such that any positive value indicates hydrogen gas in excess of the baseline.

In some embodiments, method 600 can perform further data cleaning and analytics at 604 along with the baseline concentration analysis. In these embodiments, method 600 can further include one or more additional steps selected from the group consisting of assessing peaks in the raw advanced mud gas data compared to a standard deviation thereof, replacing outliers of the raw advanced mud gas data at said peaks with averaged concentration values from data points adjacent to the peaks (e.g., via de-spiking module 108), and constructing a discount function to correct for an overestimation of hydrogen gas in the advanced mud gas data (e.g., via discount function module 112) based upon measurements of the additional data received at 602. These additional steps can further adjust the received raw AMG data, and can account for any outlying values and any contamination of the mud, such that the cleaned data can be utilized with increased confidence.

Method 600 can accordingly continue at 606 with constructing corrected hydrogen gas concentration curves via cleaning of the raw advanced mud gas data (e.g., via data cleaning engine 102). The corrected hydrogen gas concentration curves can include hydrogen gas concentrations in parts per million, with the baseline concentration removed from each reading and one or more cleaning techniques applied thereto. Using the corrected hydrogen gas concentration curves, method 600 can continue at 608 with transforming the corrected hydrogen gas concentration curves into corresponding hydrogen gas concentration indices to categorize hydrogen shows by strength (e.g., via mud gas data interpretation engine 114 and index value module 116). The transformation at 608 can convert the hydrogen concentration measurements from scientific units into an index ranging from zero to one, with the index scaling non-linearly from zero to one (see FIG. 3A). In some embodiments, the hydrogen gas concentration indices can be further modified based upon the presence of other gases in the mud and wellbore. As such, method 600 at 608 can further include determining a ratio between hydrogen gas and other mud gases from the advanced mud gas data and offsetting the hydrogen gas concentration indices based upon said ratio (e.g., via mud gas weighting module 118). The determination of a ratio and accordingly offsetting the hydrogen gas concentration indices can increase confidence in the end results of method 600, such that the presence or absence of other mud gases can indicate increased or decreased levels of hydrogen gas concentration.

Once the hydrogen gas concentration indices are constructed for each depth, method 600 can continue at 610 with grouping the hydrogen gas concentration indices by geographical location to identify potential sources of hydrogen gas for extraction operations (e.g., via statistical compilation module 122). The grouping of the indices by location, well, and formation at 610 can enable the use of mapping tools (e.g., mapping engine 120) to construct user-readable images that indicate these potential sources of hydrogen gas. In further embodiments, statistical analysis can be performed at 610 in order to identify and extract maximum, minimum, and average values for the hydrogen gas concentration indices for the wells and formations. Method 600 can accordingly continue at 612 with constructing a geographical representation of the hydrogen gas concentration indices across the geological formations to identify potential hydrogen gas reservoirs for extraction operations (e.g., via geological formation mapping module 124). The geographical representation constructed at 612 can be utilized in the identification of hydrogen gas sources, as well as the planning and deployment of extraction operations and equipment, such that hydrogen gas exploration operations can be performed with increased confidence and decreased risk.

Method 600 can similarly continue at 614 with constructing and identifying potential hydrogen gas migration pathways within the geographical representation, the potential hydrogen gas migration pathways enabling assessment of hydrogen gas presence and charge history for the geological formations (e.g., via migration pathway generation module 126). Method 600 at 614 can determine the pathways through which the hydrogen gas may have migrated and charged the various formations, through fractures, faults, porous media, man-made wellbores, and other geological features under the regions of interest. Determining both the strength of hydrogen shows and the migration pathways at 612 and 614 can enable assessment of the charge history for the region of interest while enabling risk assessments to be made for exploration and extraction operations therein. As such, in some embodiments, method 600 can continue at 616 with performing or modifying extraction operations of hydrogen gas or hydrocarbons using the geographical representation of the hydrogen gas concentration indices and identified potential hydrogen gas reservoirs. In these embodiments, the geographical representations and migration pathways extracted from the transformed AMG data can directly advise and control the exploration and extraction processes for natural hydrogen gas, such that risks and expenditures are reduced in these developing techniques.

In view of the foregoing structural and functional description, those skilled in the art will appreciate that portions of the embodiments may be embodied as a method, data processing system, or computer program product. Accordingly, these portions of the present embodiments may take the form of an entirely hardware embodiment, an entirely software embodiment, or an embodiment combining software and hardware, such as shown and described with respect to the computer system of FIG. 7. Furthermore, portions of the embodiments may be a computer program product on a computer-readable storage medium having computer readable program code on the medium. Any non-transitory, tangible storage media possessing structure may be utilized including, but not limited to, static and dynamic storage devices, volatile and non-volatile memories, hard disks, optical storage devices, and magnetic storage devices, but excludes any medium that is not eligible for patent protection under 35 U.S.C. § 101 (such as a propagating electrical or electromagnetic signals per se). As an example and not by way of limitation, computer-readable storage media may include a semiconductor-based circuit or device or other IC (such, as for example, a field-programmable gate array (FPGA) or an ASIC), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, or another suitable computer-readable storage medium or a combination of two or more of these, where appropriate. A computer-readable non-transitory storage medium may be volatile, nonvolatile, or a combination of volatile and non-volatile, as appropriate.

Certain embodiments have also been described herein with reference to block illustrations of methods, systems, and computer program products. It will be understood that blocks and/or combinations of blocks in the illustrations, as well as methods or steps or acts or processes described herein, can be implemented by a computer program comprising a routine of set instructions stored in a machine-readable storage medium as described herein. These instructions may be provided to one or more processors of a general purpose computer, special purpose computer, or other programmable data processing apparatus (or a combination of devices and circuits) to produce a machine, such that the instructions of the machine, when executed by the processor, implement the functions specified in the block or blocks, or in the acts, steps, methods and processes described herein.

These processor-executable instructions may also be stored in computer-readable memory that can direct a computer or other programmable data processing apparatus to function in a particular manner, such that the instructions stored in the computer-readable memory result in an article of manufacture including instructions which implement the function specified. The computer program instructions may also be loaded onto a computer or other programmable data processing apparatus to cause a series of operational steps to be performed on the computer or other programmable apparatus to realize a computer implemented process such that the instructions which execute on the computer or other programmable apparatus provide steps for implementing the functions specified in flowchart blocks that may be described herein.

Figure 7:
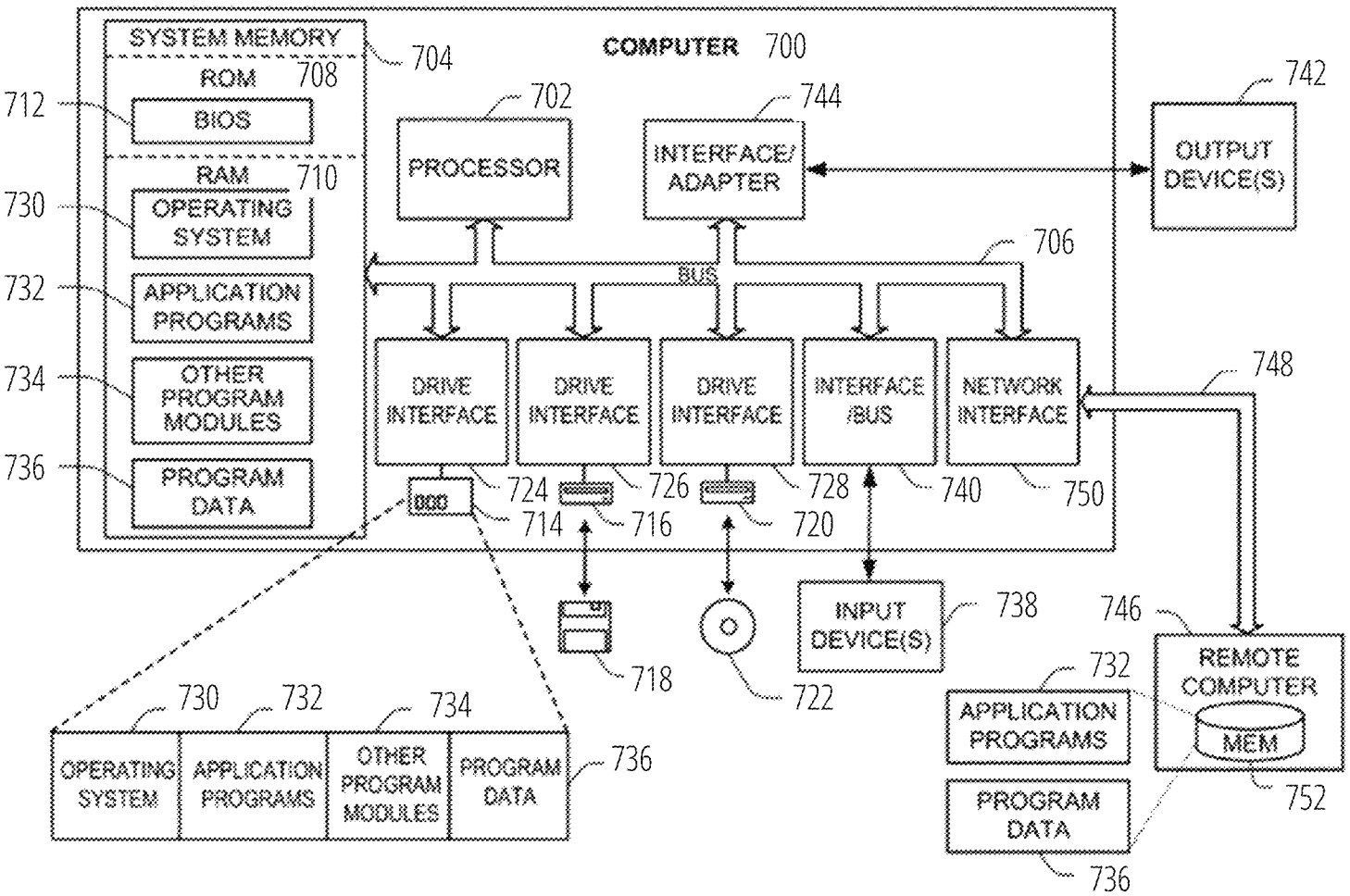
FIG. 7 illustrates one example of a computer system that can be employed to execute one or more embodiments of the present disclosure.

In this regard, FIG. 7 illustrates one example of a computer system 700 that can be employed to execute one or more embodiments of the present disclosure. Computer system 700 can be implemented on one or more general purpose networked computer systems, embedded computer systems, routers, switches, server devices, client devices, various intermediate devices/nodes, or standalone computer systems. Additionally, computer system 700 can be implemented on various mobile clients such as, for example, a personal digital assistant (PDA), laptop computer, pager, and the like, provided it includes sufficient processing capabilities.

Computer system 700 includes processing unit 702, system memory 704, and system bus 706 that couples various system components, including the system memory 704, to processing unit 702. System memory 704 can include volatile (e.g., RAM, DRAM, SDRAM, Double Data Rate (DDR) RAM, etc.) and non-volatile (e.g., Flash, NAND, etc.) memory. Dual microprocessors and other multi-processor architectures also can be used as processing unit 702. System bus 706 may be any of several types of bus structure including a memory bus or memory controller, a peripheral bus, and a local bus using any of a variety of bus architectures. System memory 704 includes read only memory (ROM) 708 and random access memory (RAM) 710. A basic input/output system (BIOS) 712 can reside in ROM 708 containing the basic routines that help to transfer information among elements within computer system 700.

Computer system 700 can include a hard disk drive 714, magnetic disk drive 716, e.g., to read from or write to removable disk 718, and an optical disk drive 720, e.g., for reading CD-ROM disk 722 or to read from or write to other optical media. Hard disk drive 714, magnetic disk drive 716, and optical disk drive 720 are connected to system bus 706 by a hard disk drive interface 724, a magnetic disk drive interface 726, and an optical drive interface 728, respectively. The drives and associated computer-readable media provide nonvolatile storage of data, data structures, and computer-executable instructions for computer system 700. Although the description of computer-readable media above refers to a hard disk, a removable magnetic disk and a CD, other types of media that are readable by a computer, such as magnetic cassettes, flash memory cards, digital video disks and the like, in a variety of forms, may also be used in the operating environment; further, any such media may contain computer-executable instructions for implementing one or more parts of embodiments shown and described herein.

A number of program modules may be stored in drives and ROM 708, including operating system 730, one or more application programs 732, other program modules 734, and program data 736. In some examples, application programs 732 can include data cleaning engine 102, baseline concentration module 106, de-spiking module 108, discount function module 112, mud gas data interpretation engine 114, index value module 116, mud gas weighting module 118, mapping engine 120, statistical compilation module 122, geological formation mapping module 124, and migration pathway generation module 126. The program data 736 can include any of the readings of raw AMG data 104 and additional reservoir data 110, the corrected hydrogen gas concentration curves, hydrogen show index values, geographical representation 128, and any combination thereof. The application programs 732 and program data 736 can include functions and methods programmed to identify and characterize the strengths of hydrogen shows in a geographical area, such as shown and described herein.

A user may enter commands and information into computer system 700 through one or more input device 738, such as a pointing device (e.g., a mouse, touch screen), keyboard, microphone, joystick, game pad, scanner, and the like. These and other input devices 738 are often connected to processing unit 702 through a corresponding port interface 740 that is coupled to the system bus, but may be connected by other interfaces, such as a parallel port, serial port, or universal serial bus (USB). One or more output devices 742 (e.g., display, a monitor, printer, projector, or other type of displaying device) is also connected to system bus 706 via interface 744, such as a video adapter.

Computer system 700 may operate in a networked environment using logical connections to one or more remote computers, such as remote computer 746. Remote computer 746 may be a workstation, computer system, router, peer device, or other common network node, and typically includes many or all the elements described relative to computer system 700. The logical connections, schematically indicated at 748, can include a local area network (LAN) and/or a wide area network (WAN), or a combination of these, and can be in a cloud-type architecture, for example configured as private clouds, public clouds, hybrid clouds, and multi-clouds. When used in a LAN networking environment, computer system 700 can be connected to the local network through a network interface or adapter 750. When used in a WAN networking environment, computer system 700 can include a modem, or can be connected to a communications server on the LAN. The modem, which may be internal or external, can be connected to system bus 706 via an appropriate port interface. In a networked environment, application programs 732 or program data 736 depicted relative to computer system 700, or portions thereof, may be stored in a remote memory storage device 752.

In further embodiments, processing may be distributed among one or more processors at the same or different locations over a network. Workflow steps 502-524, processing steps 602-616 in method 600, data cleaning engine 102 and its components (baseline concentration module 106, de-spiking module 108, discount function module 112), mud gas data interpretation engine 114 and its components (index value module 116, mud gas weighting module 118), and mapping engine 120 and its components (statistical compilation module 122, geological formation mapping module 124, migration pathway generation module 126) can be implemented on any type of computing device including, but not limited to, a laptop, desktop, tablet, workstation, mobile device or smartphone, kiosk, embedded system, or other computing device having at least one processor and a non-transitory computable readable memory. The computing device may include a browser, application, and operating system along with a user-interface depending upon a desired configuration. The computing device may have functionality performed at the same or different physical locations and by one or more processors located at the same or different locations. A computing device may also be coupled to one or more application programming interfaces (APIs) to perform or distribute aspects of the functionality described herein. Computing functionality as described herein may also be implemented on a server, cluster of servers, web server, cloud-computing platform, and/or other remote service. A client/server architecture may also be implemented as would be apparent to a person skilled in the art given this description.

Embodiments consistent with the present disclosure include:

A. A computer-implemented method for quantifying and assessing hydrogen shows in geological formations includes receiving raw advanced mud gas data including hydrogen gas and total hydrocarbon concentrations for one or more geological formations in a geographical area, calculating a baseline concentration value of hydrogen gas for each geological formation and removing said baseline concentration value from the raw advanced mud gas data, constructing corrected hydrogen gas concentration curves via cleaning of the raw advanced mud gas data, transforming the corrected hydrogen gas concentration curves into corresponding hydrogen gas concentration indices to categorize hydrogen shows by strength, and grouping the hydrogen gas concentration indices by geographical location to identify potential sources of hydrogen gas for extraction operations.

B. A system for quantifying and assessing hydrogen shows in geological formations includes a data cleaning engine operable to receive advanced mud gas data and construct corrected hydrogen gas concentration curves, the data cleaning engine including a baseline concentration module operable to calculate a baseline concentration value of hydrogen gas for each geological formation and remove said baseline concentration value from the advanced mud gas data. The system further includes a mud gas data interpretation engine operable to receive the corrected hydrogen gas concentration curves and perform further transformations to categorize hydrogen shows by strength, the mud gas data interpretation engine including an index value module operable to transform the corrected hydrogen gas concentration curves into corresponding hydrogen gas concentration indices, and a mud gas weighting module operable to determine a ratio between hydrogen gas and other mud gases from the advanced mud gas data and offset the hydrogen gas concentration indices based upon said ratio, said hydrogen gas concentration indices representing a standardized, relative strength of each hydrogen show in the geological formations for potential hydrogen gas extraction operations.

C. A non-transitory computer-readable medium storing machine-readable instructions, which, when executed by a processor of an electronic device, cause the electronic device to receive raw advanced mud gas data including hydrogen gas and total hydrocarbon concentrations for one or more formations in a geographical area, calculate a baseline concentration value of hydrogen gas for each formation and remove said baseline concentration value from the raw advanced mud gas data, and construct a discount function to correct for an overestimation of hydrogen gas concentration in the raw advanced mud gas data based upon additives, corrosion, drilling mud content, or any combination thereof to construct corrected hydrogen gas concentration curves. The instructions further cause the electronic device to transform the corrected hydrogen gas concentration curves into corresponding hydrogen gas concentration indices to categorize hydrogen shows by strength, determine a ratio between hydrogen gas and other mud gases from the advanced mud gas data and offset the hydrogen gas concentration indices based upon said ratio, construct a geographical representation of the hydrogen gas concentration indices across the formations to identify potential hydrogen gas reservoirs for the potential hydrogen gas extraction operations, and construct and identify potential hydrogen gas migration pathways within the geographical representation, the potential hydrogen gas migration pathways enabling assessments of hydrogen gas presence and charge history for the formations.

Each of Embodiments A through C may have one or more of the following additional elements in any combination: Element 1: wherein cleaning of the raw advanced mud gas data includes: assessing peaks in the raw advanced mud gas data compared to one or more standard deviations thereof; and replacing outliers of the raw advanced mud gas data at said peaks with averaged concentration values from data points adjacent to said peaks. Element 2: wherein cleaning of the raw advanced mud gas data includes: receiving additional data including mud type data, lithography data, rate of penetration data, or a combination thereof; and constructing a discount function to correct for an overestimation of hydrogen gas in the advanced mud gas data based upon measurements of the additional data. Element 3: further comprising: determining a ratio between hydrogen gas and other mud gases from the advanced mud gas data and offsetting the hydrogen gas concentration indices based upon said ratio. Element 4: further comprising: constructing a geographical representation of the hydrogen gas concentration indices across the geological formations to identify potential hydrogen gas reservoirs for extraction operations. Element 5: further comprising: constructing and identifying potential hydrogen gas migration pathways within the geographical representation, the potential hydrogen gas migration pathways enabling assessment of hydrogen gas presence and charge history for the geological formations.

Element 6: further comprising: performing or modifying extraction operations of hydrogen gas or hydrocarbons using the geographical representation of the hydrogen gas concentration indices and identified potential hydrogen gas reservoirs. Element 7: further comprising: a mapping engine operable to construct a geographical representation of the hydrogen gas concentration indices across the geological formations to identify potential hydrogen gas reservoirs for the potential hydrogen gas extraction operations. Element 8: wherein the mapping engine comprises: a statistical compilation module operable to extract a maximum, a minimum, and an average hydrogen gas concentration index for each geological formation to identify potential hydrogen gas reservoirs for the potential hydrogen gas extraction operations. Element 9: wherein the mapping engine comprises: a migration pathway generation module operable to construct and identify potential hydrogen gas migration pathways within the geographical representation, the potential hydrogen gas migration pathways enabling assessments of hydrogen gas presence and charge history for the geological formations. Element 10: wherein the data cleaning engine further includes: a discount function module operable to construct a discount function to correct for an overestimation of hydrogen gas in the advanced mud gas data based upon additives, corrosion, drilling mud content, or any combination thereof. Element 11: wherein the data cleaning engine further receives mud type data, lithography data, rate of penetration data, or a combination thereof to be used in the discount function module in correcting for the overestimation of hydrogen gas.

Element 12: wherein the data cleaning engine further includes: a de-spiking module operable to assess peaks in the advanced mud gas data compared to a standard deviation thereof and to replace outliers at said peaks of the advanced mud gas data with averaged concentration values from data points adjacent to said peaks. Element 13: wherein the hydrogen gas concentration indices range from zero to one, wherein a hydrogen gas concentration index of 0.1 indicates a hydrogen gas concentration of about 500 ppm, and wherein a hydrogen gas concentration index of 1 indicates a hydrogen gas concentration of about 100,000 ppm. Element 14: wherein the instructions causing the electronic device to offset the hydrogen gas concentration indices further include instructions that cause the electronic device to: decrease values of the hydrogen gas concentration indices if the ratio between the hydrogen gas and the mud gases is less than or equal to about 0.5; and increase values of the hydrogen gas concentration indices if the ratio between the hydrogen gas and the mud gases is greater than or equal to about 1. Element 15: wherein the instructions, when executed by the processor of the electronic device, further cause the electronic device to: extract a maximum, a minimum, and an average hydrogen gas concentration index for each formation to identify potential hydrogen gas reservoirs, wherein the formation includes a plurality of grouped hydrogen gas concentration indices therein. Element 16: wherein the instructions, when executed by the processor of the electronic device, further cause the electronic device to: assess peaks in the raw advanced mud gas data compared to a standard deviation thereof; and replace outliers of the raw advanced mud gas data at said peaks with averaged concentration values from data points adjacent to said peaks. Element 17: wherein the instructions, when executed by the processor of the electronic device, further cause the electronic device to: receive mud type data, lithography data, rate of penetration data, or a combination thereof to be used in correcting for the overestimation of hydrogen gas via the discount function.

By way of non-limiting example, exemplary combinations applicable to A through C include: Element 4 with Element 5; Element 4 with Element 6; Element 7 with Element 8; Element 7 with Element 9; and Element 10 with Element 11.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A computer-implemented method for quantifying and assessing hydrogen shows in geological formations, the method comprising:

receiving raw advanced mud gas data including hydrogen gas and total hydrocarbon concentrations for one or more geological formations in a geographical area;

calculating a baseline concentration value of hydrogen gas for each geological formation and removing said baseline concentration value from the raw advanced mud gas data;

constructing corrected hydrogen gas concentration curves via cleaning of the raw advanced mud gas data;

transforming the corrected hydrogen gas concentration curves into corresponding hydrogen gas concentration indices to categorize hydrogen shows by strength; and grouping the hydrogen gas concentration indices by geographical location to identify potential sources of hydrogen gas for extraction operations.

2. The computer-implemented method of claim 1, wherein cleaning of the raw advanced mud gas data includes:

assessing peaks in the raw advanced mud gas data compared to one or more standard deviations thereof; and replacing outliers of the raw advanced mud gas data at said peaks with averaged concentration values from data points adjacent to said peaks.

3. The computer-implemented method of claim 1, wherein cleaning of the raw advanced mud gas data includes:

receiving additional data including mud type data, lithography data, rate of penetration data, or a combination thereof; and constructing a discount function to correct for an overestimation of hydrogen gas in the advanced mud gas data based upon measurements of the additional data.

4. The computer-implemented method of claim 1, further comprising:

determining a ratio between hydrogen gas and other mud gases from the advanced mud gas data and offsetting the hydrogen gas concentration indices based upon said ratio.

5. The computer-implemented method of claim 1, further comprising:

constructing a geographical representation of the hydrogen gas concentration indices across the geological formations to identify potential hydrogen gas reservoirs for extraction operations.

6. The computer-implemented method of claim 5, further comprising:

constructing and identifying potential hydrogen gas migration pathways within the geographical representation, the potential hydrogen gas migration pathways enabling assessment of hydrogen gas presence and charge history for the geological formations.

7. The computer-implemented method of claim 5, further comprising:

performing or modifying extraction operations of hydrogen gas or hydrocarbons using the geographical representation of the hydrogen gas concentration indices and identified potential hydrogen gas reservoirs.

8. A system for quantifying and assessing hydrogen shows in geological formations, the system comprising:

a data cleaning engine operable to receive advanced mud gas data and construct corrected hydrogen gas concentration curves, the data cleaning engine including:

a baseline concentration module operable to calculate a baseline concentration value of hydrogen gas for each geological formation and remove said baseline concentration value from the advanced mud gas data; and a mud gas data interpretation engine operable to receive the corrected hydrogen gas concentration curves and perform further transformations to categorize hydrogen shows by strength, the mud gas data interpretation engine including:

an index value module operable to transform the corrected hydrogen gas concentration curves into corresponding hydrogen gas concentration indices, and a mud gas weighting module operable to determine a ratio between hydrogen gas and other mud gases from the advanced mud gas data and offset the hydrogen gas concentration indices based upon said ratio, wherein the hydrogen gas concentration indices represent a standardized, relative strength of each hydrogen show in the geological formations for potential hydrogen gas extraction operations.

9. The system of claim 8, further comprising:

a mapping engine operable to construct a geographical representation of the hydrogen gas concentration indices across the geological formations to identify potential hydrogen gas reservoirs for the potential hydrogen gas extraction operations.

10. The system of claim 9, wherein the mapping engine comprises:

a statistical compilation module operable to extract a maximum, a minimum, and an average hydrogen gas concentration index for each geological formation to identify potential hydrogen gas reservoirs for the potential hydrogen gas extraction operations.

11. The system of claim 9, wherein the mapping engine comprises:

a migration pathway generation module operable to construct and identify potential hydrogen gas migration pathways within the geographical representation, the potential hydrogen gas migration pathways enabling assessments of hydrogen gas presence and charge history for the geological formations.

12. The system of claim 8, wherein the data cleaning engine further includes:

a discount function module operable to construct a discount function to correct for an overestimation of hydrogen gas in the advanced mud gas data based upon additives, corrosion, drilling mud content, or any combination thereof.

13. The system of claim 12, wherein the data cleaning engine further receives mud type data, lithography data, rate of penetration data, or a combination thereof to be used in the discount function module in correcting for the overestimation of hydrogen gas.

14. The system of claim 8, wherein the data cleaning engine further includes:

a de-spiking module operable to assess peaks in the advanced mud gas data compared to a standard deviation thereof and to replace outliers at said peaks of the advanced mud gas data with averaged concentration values from data points adjacent to said peaks.

15. The system of claim 8, wherein the hydrogen gas concentration indices range from zero to one, wherein a hydrogen gas concentration index of 0.1 indicates a hydrogen gas concentration of about 500 ppm, and wherein a hydrogen gas concentration index of 1 indicates a hydrogen gas concentration of about 100,000 ppm.

16. A non-transitory computer-readable medium storing machine-readable instructions, which, when executed by a processor of an electronic device, cause the electronic device to:

receive raw advanced mud gas data including hydrogen gas and total hydrocarbon concentrations for one or more formations in a geographical area;

calculate a baseline concentration value of hydrogen gas for each formation and remove said baseline concentration value from the raw advanced mud gas data;

construct a discount function to correct for an overestimation of hydrogen gas concentration in the raw advanced mud gas data based upon additives, corrosion, drilling mud content, or any combination thereof to construct corrected hydrogen gas concentration curves;

transform the corrected hydrogen gas concentration curves into corresponding hydrogen gas concentration indices to categorize hydrogen shows by strength;

determine a ratio between hydrogen gas and other mud gases from the advanced mud gas data and offset the hydrogen gas concentration indices based upon said ratio;

construct a geographical representation of the hydrogen gas concentration indices across the formations to identify potential hydrogen gas reservoirs for the potential hydrogen gas extraction operations; and construct and identify potential hydrogen gas migration pathways within the geographical representation, the potential hydrogen gas migration pathways enabling assessments of hydrogen gas presence and charge history for the formations.

17. The non-transitory computer-readable medium of claim 16, wherein the instructions causing the electronic device to offset the hydrogen gas concentration indices further include instructions that cause the electronic device to:

decrease values of the hydrogen gas concentration indices if the ratio between the hydrogen gas and the mud gases is less than or equal to about 0.5; and increase values of the hydrogen gas concentration indices if the ratio between the hydrogen gas and the mud gases is greater than or equal to about 1.

18. The non-transitory computer-readable medium of claim 16, wherein the instructions, when executed by the processor of the electronic device, further cause the electronic device to:

extract a maximum, a minimum, and an average hydrogen gas concentration index for each formation to identify potential hydrogen gas reservoirs, wherein the formation includes a plurality of grouped hydrogen gas concentration indices therein.

19. The non-transitory computer-readable medium of claim 16, wherein the instructions, when executed by the processor of the electronic device, further cause the electronic device to:

assess peaks in the raw advanced mud gas data compared to a standard deviation thereof; and replace outliers of the raw advanced mud gas data at said peaks with averaged concentration values from data points adjacent to said peaks.

20. The non-transitory computer-readable medium of claim 16, wherein the instructions, when executed by the processor of the electronic device, further cause the electronic device to:

receive mud type data, lithography data, rate of penetration data, or a combination thereof to be used in correcting for the overestimation of hydrogen gas via the discount function.

* * * * *